United States Patent [19]

Twilton

[11] Patent Number: 5,040,512

[45] Date of Patent: Aug. 20, 1991

[54] FUEL INJECTION SYSTEM

[75] Inventor: Stewart Twilton, Solihull, England

[73] Assignee: Lucas Industries public limited company, England

[21] Appl. No.: 616,483

[22] Filed: Nov. 21, 1990

[30] Foreign Application Priority Data

Nov. 22, 1989 [GB] United Kingdom ..... 8926363

[51] Int. Cl.[5] ..... F02M 39/00

[52] U.S. Cl. ..... 123/470; 123/456; 123/468

[58] Field of Search ..... 123/456, 468, 469, 470, 123/472

[56] References Cited

U.S. PATENT DOCUMENTS

| | | | |
|---|---|---|---|
| 4,240,384 | 12/1980 | Urbinati et al. | 123/470 |
| 4,246,877 | 1/1981 | Kennedy | 123/470 |
| 4,307,693 | 12/1981 | Glöckler et al. | 123/469 |
| 4,474,160 | 10/1984 | Gartner | 123/468 |
| 4,539,961 | 9/1985 | Atkins et al. | 123/469 |
| 4,570,602 | 2/1986 | Atkins et al. | 123/468 |
| 4,586,477 | 5/1986 | Field et al. | 123/468 |
| 4,823,754 | 4/1989 | Minamoto et al. | 123/470 |
| 4,829,965 | 5/1989 | Gartner | 123/470 |
| 4,984,548 | 1/1991 | Hudson, Jr. | 123/470 |
| 4,991,557 | 2/1991 | DeGrace et al. | 123/468 |

FOREIGN PATENT DOCUMENTS

| | | | |
|---|---|---|---|
| 3739108 | 6/1989 | Fed. Rep. of Germany | 123/469 |

*Primary Examiner*—Carl Stuart Miller
*Assistant Examiner*—Thomas N. Moulis
*Attorney, Agent, or Firm*—Jenner & Block

[57] ABSTRACT

A clip for securing the inlet of a fuel injection nozzle within a tubular outlet extending from a petrol supply manifold has a pair of spaced side plates which are interconnected by a bridging member. The side plates have internal ears which locate in slots on opposite sides of the injector, slots in the side plates which receive a rim on the tubular outlet. The side plates are extended to define tongues which extend into engagement with the surface of the manifold to locate the clip and therefore the injector in a predetermined angular relationship in the tubular outlet.

5 Claims, 2 Drawing Sheets

FUEL INJECTION SYSTEM

This invention relates to a clip for use in a petrol injection system of an internal combustion engine, a system comprising an elongated hollow petrol supply manifold having a plurality of hollow tubular outlets projecting from the manifold at spaced intervals therealong, a plurality of injectors each having an axially disposed fuel inlet which in use is located within a respective one of said tubular outlets, and a plurality of clips which serve to secure the injectors relative to the tubular outlets, each of said clips comprising a pair of side plates which extend in generally parallel spaced relationship, an integral bridging plate which interconnects said side plates and a pair of ears extending inwardly from said side plates respectively, said ears being shaped for engagement within slots formed on opposite sides of the respective injector so that the clip is secured to the injector in non-rotatable engagement therewith, said side plates having slots respectively which in use accommodate portions of a lip formed about each of said outlets whereby the inlet of the injector is secured within the respective outlet.

In the use of the system the manifold is secured to the engine structure and the outlet portions of the injectors project into the air inlet ducts of the engine. With injectors which have an axially disposed outlet the angular disposition of the injectors has little influence on the operation of the associated engine. However, where the injectors have two or more outlets and produce sprays which may or may not diverge from the axis of the injector, it is essential that the angular disposition of the injector should be correct so as to ensure that the fuel sprays follow the desired paths within the air inlet ducts.

GB 2073316A discloses one way of ensuring the correct angular disposition of a plurality of injectors and in which the fuel inlet manifold also carries one part of the electrical connectors which carry electrical current to the injectors. The other part of the connector is carried by the injector and the two parts of the connector can only be engaged when the injectors are in the correct angular relationship. It is not always convenient to combine the fuel supplying function and the electrical function in a single unit.

A further example of a mounting arrangement for an injector is seen in EP 0102164. In this case the clip is provided with a pair of spaced legs which locate within slots formed in the opposite sides of the injector and also within slots formed in the internal surface of a hollow boss in which the injector is mounted. Before the clip can be pushed into position the slots in the injector must be aligned with those in the boss a task not made easy by the fact that the tubular inlet of the injector in which the slots are formed is provided with a seal ring which forms a seal between the injector and the wall of the boss.

The object of the present invention is to provided a clip of the kind set forth in a simple and convenient form.

According to the invention a clip of the kind specified is characterised by integral tongues which extend from the side plates respectively for engagement with a surface of the manifold, the tongues acting to locate the clip and the injector in a pre-determined angular relationship relative to the tubular outlets.

An example of a clip and a fuel injection system incorporating the clip will now be described with reference to the accompanying drawings in which.

Figure 4:
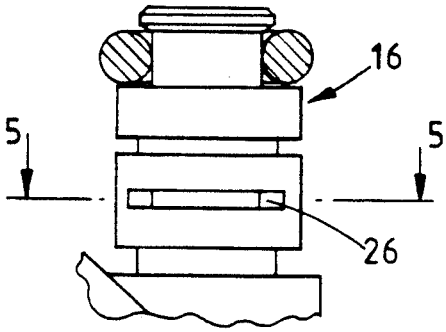
FIG. 4 shows the end portion of the fuel injector
Figure 5:
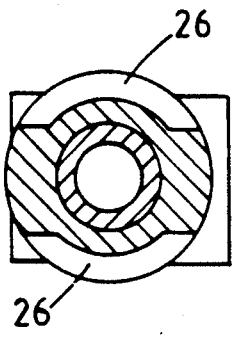
FIG. 5 shows a section of the injector taken on the live 5—5 of FIG. 4.

Referring to the drawings the injector which is generally indicated at 10 is of generally stepped cylindrical form and has its outlet end 11 extending into a recess 12 which forms an extension of a branch 13 of an air inlet duct 14 of an engine. Part of the engine structure is indicated in sectional outline at 15. The injector has an axially disposed inlet which is best seen at 16 in FIG. 4. The injector is electrically controlled and part of the electrical coupling is seen at 17 in FIG. 1.

Figure 1:
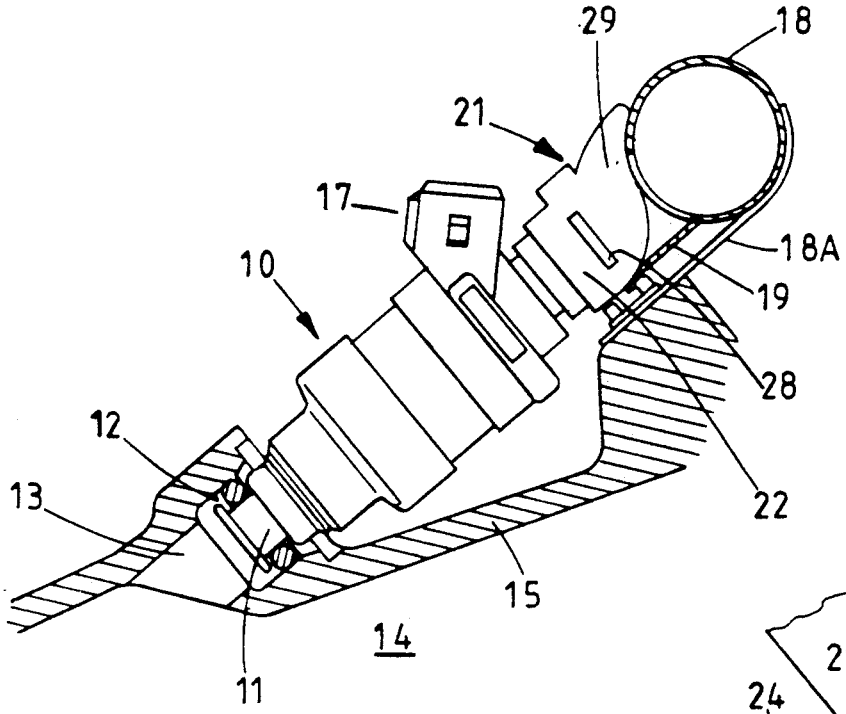
FIG. 1 shows an injector in outline which is located on the engine structure and connected to the fuel inlet manifold.
Figure 3:
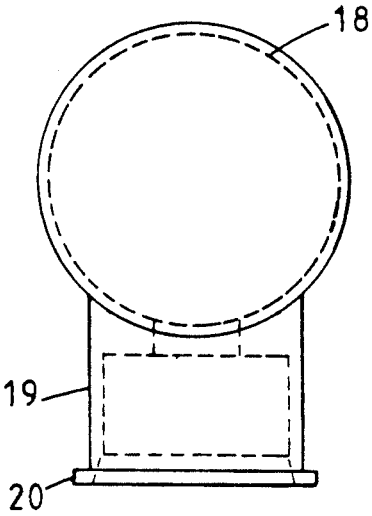
FIG. 3 is a section through the inlet manifold to an enlarged scale.

Fuel is supplied to the fuel inlet 16 of the injector by way of a petrol supply manifold which is indicated at 18 in FIG. 1, the manifold in the particular example being of circular section and formed from metal. The manifold is provided with a support 18A by which it is secured to the engine structure 15. As shown more clearly in FIG. 3, the manifold 18 is provided with a hollow tubular outlet 19 and the manifold will have a plurality of such outlets at spaced intervals along the length thereof. Each outlet has at its extremity, an annular lip 20.

Figure 2:
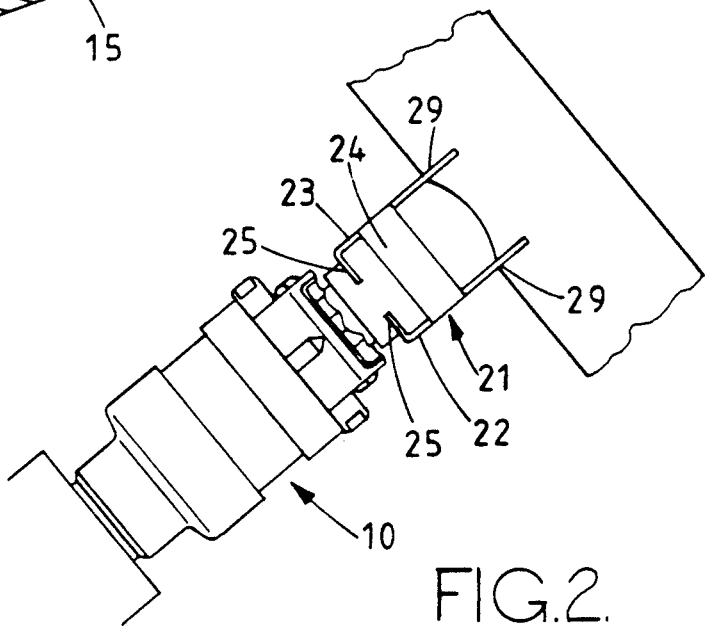
FIG. 2 is a view taken at right angles to FIG. 1.
Figure 6:
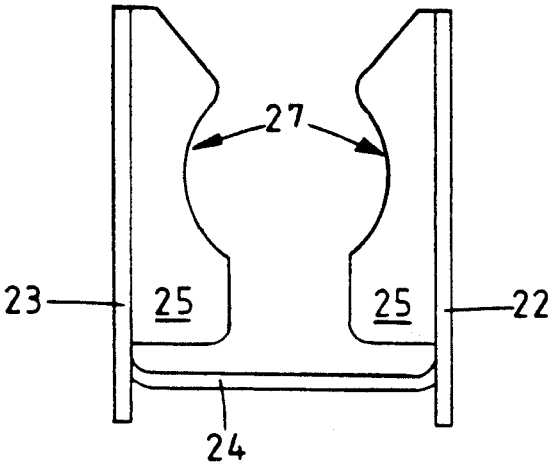
FIG. 6 is a plan view of a clip.
Figure 7:
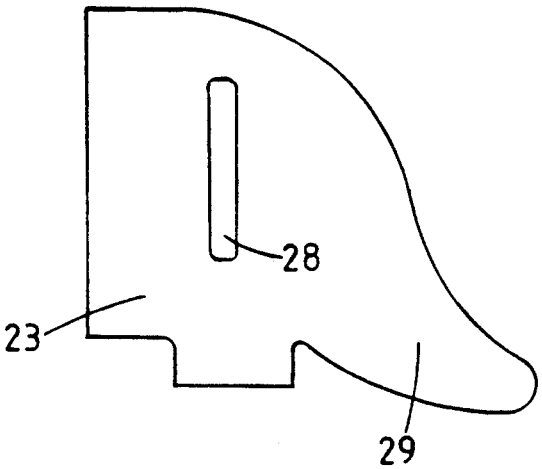
FIG. 7 is a side view of the clip shown in FIG. 6.

The accepted practice is to secure the inlets 16 of the injectors within the tubular outlets 19 of the manifold 18 using a clip so that when the manifold is removed from the engine structure the injectors remain secured to the manifold. Where the outlet of the injector is provided with a pair of orifices it is necessary to ensure the correct angular relationship of the injector and this can be achieved in accordance with the invention, by the use of a clip which is indicated at 21 in FIGS. 1 and 2. The clip is seen in greater detail in FIGS. 6 and 7 and referring to these figures the clip comprises a pair of side plates 22, 23 which are located in generally spaced parallel relationship and which are inter-connected by an integral bridging plate 24. The side plates respectively are provided with inwardly extending integral ears 25 which can be engaged within slots 26 which extend transversely in a cylindrical portion of the nozzle body adjacent the inlet 16. Each slot 26 is of part circumferential form and the tongues 25 have arcuate cut-outs 27 intermediate their ends. The ears also are shaped at their end portions remote from the bridging plate to facilitate the engagement of the ears within the slots.

The side plates 22, 23 are each provided with a slot 28 which when the inlet of the injector is accommodated within the outlet 19 of the manifold, accommodate parts of the lip 20. The engagement of the ears of the clip within the slots 26 is set as to prevent angular movement of the clip relative to the injector but the engagement of the lip 20 within the slots 28 does not prevent angular movement of the injector within the outlet. In the example such angular movement is prevented by extending the side plates 22, 23 to define tongues 29 the end edges of which are shaped to engage with part of the peripheral surface of the manifold 18 on one side of a plane including the longitudinal axes of the injectors. In the particular example said edges of the tongues are of arcuate form. Since the tongues 29 are offset from the axis of the injector, such engagement prevents angular movement of the injector and clip and therefore the injector is positively located against angular movement within the recesses 12. Providing the outlet orifices which are located within the outlet 11 of the injector are correctly orientated, the fuel sprays will issue in the correct direction within the respective inlet ducts 14.

I claim:

1. A clip for use in a petrol injection system of an internal combustion engine, the system comprising an elongated hollow petrol supply manifold having a plurality of hollow tubular outlets projecting from the manifold at spaced intervals therealong, a plurality of injectors each having an axially disposed fuel inlet which in use is located within a respective one of said tubular outlets, and a plurality of clips which serve to secure the injectors relative to the tubular outlets, each of said clips comprising a pair of side plates which extend in generally parallel spaced relationship, an integral bridging plate which interconnects said side plates and a pair of ears extending inwardly from said side plates respectively, said ears being shaped for engagement within slots formed on opposite sides of the respective injector so that the clip is secured to the injector in non-rotatable engagement therewith, said side plates having slots respectively which in use accommodate portions of a lip formed about each of said tubular outlets whereby the inlet of the injector is secured within the respective tubular outlet, said side plates defining integral tongues which in use, engage a surface of the manifold, the tongues acting to locate the clip and the injector in a predetermined angular relationship relative to the tubular outlet.

2. A clip according to claim 1 in which said tongues extend in the planes of said side plates respectively.

3. A clip according to claim 2 in which the shapes of the end edges of said tongues are shaped to the profile of said surface of the manifold.

4. A clip according to claim 3 in which the edges of said tongues engage with the surface of the manifold on one side of a plane including the longitudinal axes of the injectors.

5. A clip according to claim 4 in which the surface of the manifold is of cylindrical form and the edges of the tongues which engage said surface are of arcuate form.

* * * * *